US011746497B2

(12) United States Patent
Shiratani et al.

(10) Patent No.: US 11,746,497 B2
(45) Date of Patent: Sep. 5, 2023

(54) SHOVEL

(71) Applicant: SUMITOMO CONSTRUCTION MACHINERY CO., LTD., Tokyo (JP)

(72) Inventors: Ryuji Shiratani, Chiba (JP); Hajime Aragaki, Chiba (JP); Masaaki Yamamoto, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 479 days.

(21) Appl. No.: 16/986,598

(22) Filed: Aug. 6, 2020

(65) Prior Publication Data

US 2020/0362532 A1 Nov. 19, 2020

Related U.S. Application Data

(63) Continuation of application No. PCT/JP2019/001295, filed on Jan. 17, 2019.

(30) Foreign Application Priority Data

Feb. 9, 2018 (JP) ..... 2018-022017

(51) Int. Cl.

| | |
|---|---|
| ***E02F 3/43*** | (2006.01) |
| ***E02F 3/32*** | (2006.01) |
| ***E02F 9/20*** | (2006.01) |
| ***E02F 9/22*** | (2006.01) |

(52) U.S. Cl.

CPC ..... *E02F 3/435* (2013.01); *E02F 3/32* (2013.01); *E02F 9/2004* (2013.01); *E02F 9/2033* (2013.01); *E02F 9/2228* (2013.01); *E02F 9/2267* (2013.01); *E02F 9/2285* (2013.01); *E02F 9/2292* (2013.01); *E02F 9/2296* (2013.01)

(58) Field of Classification Search

CPC ..... E02F 3/435; E02F 9/2033; E02F 9/2025; E02F 9/2267

See application file for complete search history.

(56) References Cited

U.S. PATENT DOCUMENTS

| | | | |
|---|---|---|---|
| 10,024,031 B2 | 7/2018 | Yanagisawa | |
| 2017/0276151 A1 | 9/2017 | Joung | |

FOREIGN PATENT DOCUMENTS

| | | | |
|---|---|---|---|
| JP | S62-086234 | | 4/1987 |
| JP | H04-231524 | | 8/1992 |
| JP | 2007-090909 | | 4/2007 |
| JP | 2008-169640 | | 7/2008 |
| JP | 2008169640 A | * | 7/2008 |
| JP | 2009-068173 | | 4/2009 |
| JP | 2009068173 A | * | 4/2009 |

(Continued)

OTHER PUBLICATIONS

International Search Report for PCT/JP2019/001295 dated Apr. 16, 2019.

*Primary Examiner* — Abiy Teka
(74) *Attorney, Agent, or Firm* — IPUSA, PLLC

(57) ABSTRACT

A shovel includes a traveling body, a turning body turnably mounted on the traveling body, an attachment attached to the turning body and including a boom, an arm, and a bucket, and a processor, wherein the processor is configured to relatively slow down an operation of the attachment in such a direction as to terminate a state in which the traveling body is lifted, after the shovel enters the state in which the traveling body is lifted.

9 Claims, 10 Drawing Sheets

(56) References Cited

FOREIGN PATENT DOCUMENTS

| | | |
|---|---|---|
| JP | 2011-245909 | 12/2011 |
| JP | 2015-196973 | 11/2015 |
| JP | 2016-003481 | 1/2016 |
| JP | 2016-173031 | 9/2016 |

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2019/001295, filed on Jan. 17, 2019, and designating the U.S., which claims priority to Japanese patent application 2018-22017 filed on Feb. 9, 2018. The entire contents of the foregoing applications are incorporated herein by reference.

BACKGROUND

Technical Field

The present disclosure relates to a shovel.

Description of Related Art

A shovel may be in a state in which a part of the traveling body is lifted, and the weight of the shovel is supported by a part of the traveling body contacting the ground and a part of the attachment contacting the ground (hereinafter referred to as "jacked-up state").

For example, during excavation work using the shovel, the front part of the traveling body may be lifted due to an excavation reaction force, and as a result, the shovel may get into the jacked-up state.

Also, for example, in order to drop the mud attached to the crawler of the lower traveling body, the shovel may be held in the jacked-up state in which one of the pair of left and right crawlers is in contact with the ground while the other crawler is lifted.

SUMMARY

According to an aspect of the present disclosure, a shovel includes a traveling body, a turning body turnably mounted on the traveling body, an attachment attached to the turning body and including a boom, an arm, and a bucket, and a processor, wherein the processor is configured to relatively slow down an operation of the attachment in such a direction as to terminate a state in which the traveling body is lifted, after the shovel enters the state in which the traveling body is lifted.

EMBODIMENT OF THE INVENTION

In a case where the jacked-up state of the shovel is terminated, depending on the situation, the traveling body may come into contact with the ground upon dropping down rapidly with a part of the traveling body being lifted, and this may cause a relatively large shock to the vehicle body of the shovel. Therefore, a scope for improvement is associated with the life of the shovel, the safety of the shovel, and the surroundings of the shovel.

Therefore, in view of the above problems, it is desired to provide a shovel capable of reducing a shock that occurs in the vehicle body when the jacked-up state is terminated.

Hereinafter, an embodiment for carrying out the invention is described with reference to the drawings.

[Overview of Shovel]

First, an overview of a shovel 500 according to the present embodiment will be explained with reference to FIG. 1.

Figure 1:
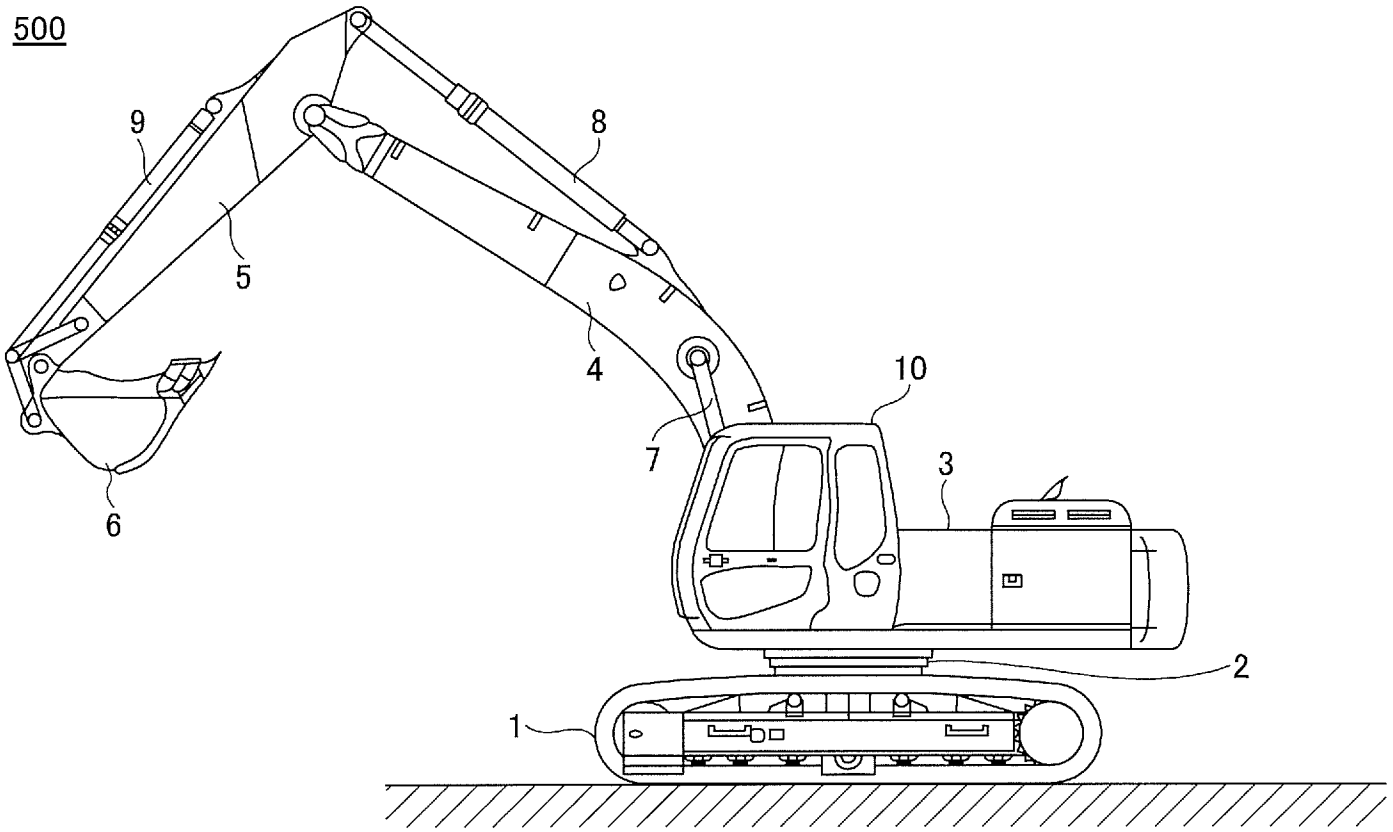
FIG. 1 is a side view of a shovel.

FIG. 1 is a side view of the shovel 500 according to the present embodiment.

The shovel 500 according to the present embodiment includes a lower traveling body 1, an upper turning body 3 mounted on the lower traveling body 1 in a turnable manner with a turn mechanism 2, a boom 4, an arm 5, a bucket 6, and a cab 10 in which an operator rides. The boom 4, the arm 5, and the bucket 6 serve as an attachment (an operation apparatus). Hereinafter, a front side of the shovel 500 corresponds to a direction in which an attachment extends with reference to the upper turning body 3 (hereinafter simply referred to as a "direction in which the attachment extends") when the shovel 500 is seen in a plan view as seen from immediately above along the turning axis of the upper turning body 3 (hereinafter simply referred to as a "plan view"). The left-hand side and the right-hand side of the shovel 500 correspond to the left-hand side and the right-hand side, respectively, of the operator in the cab 10 when the shovel 500 is seen in the plan view.

The lower traveling body 1 (an example of a traveling body) includes, for example, a pair of right and left crawlers. The crawlers are hydraulically driven by traveling hydraulic motors 1A, 1B (see FIG. 2) to cause the shovel 500 to travel.

The upper turning body 3 (an example of a turning body) is driven by a turning hydraulic motor 21 (see FIG. 2) to turn with reference to the lower traveling body 1.

The boom 4 is pivotally attached to the front center of the upper turning body 3 to be able to vertically pivot. The arm 5 is pivotally attached to the end of the boom 4 to be able to pivot vertically. The bucket 6 is pivotally attached to the end of the arm 5. The boom 4, the arm 5, and the bucket 6 are hydraulically driven by a boom cylinder 7, an arm cylinder 8, and a bucket cylinder 9, respectively, serving as hydraulic actuators.

The cab 10 is an operation room in which the operator rides, and is mounted on the front left of the upper turning body 3.

[Basic Configuration of Shovel]

Next, a basic configuration of the shovel 500 is described with reference to FIG. 2.

Figure 2:
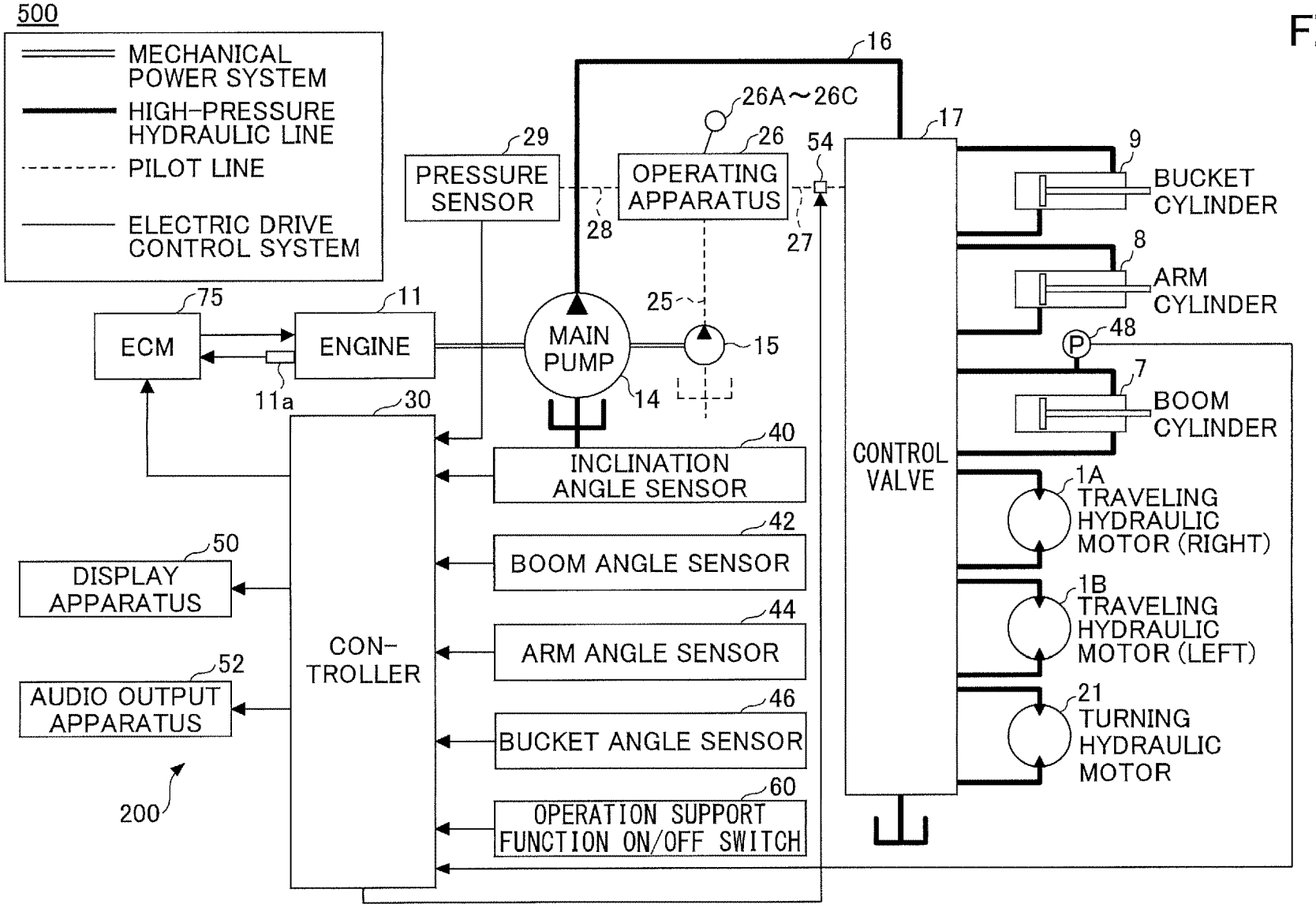
FIG. 2 is a block diagram illustrating an example of configuration of a shovel.

FIG. 2 is a block diagram illustrating an example of a configuration of the shovel 500 according to the present embodiment.

In drawing, a mechanical power line, a high-pressure hydraulic line, a pilot line, and an electric drive and control system are indicated by a double line, a thick solid line, a dashed line, and a thin solid line, respectively. This is also applicable to FIGS. 4 and 6 to be explained later.

A hydraulic drive system that hydraulically drives hydraulic actuators of the shovel 500 according to this embodiment includes an engine 11, an electric motor 12, a speed reducer 13, a main pump 14, and a control valve 17. As described above, the hydraulic drive system of the shovel 500 according to this embodiment includes hydraulic actuators such as the traveling hydraulic motors 1A and 1B, the turning hydraulic motor 21, the boom cylinder 7, the arm cylinder 8, and the bucket cylinder 9, which hydraulically drive the lower traveling body 1, the upper turning body 3, the boom 4, the arm 5, and the bucket 6, respectively, as described above.

The engine 11 is a main power source in the hydraulic drive system, and is mounted on the rear part of the upper turning body 3, for example. Specifically, under the control of an engine control module (ECM) 75, which will be described later, the engine 11 rotates constantly at a preset target rotational speed, and drives the main pump 14 and a pilot pump 15. The engine 11 is, for example, a diesel engine using light oil as fuel.

The main pump 14 is mounted, for example, on the rear part of the upper turning body 3, like the engine 11, and supplies hydraulic oil to the control valve 17 through a high-pressure hydraulic line 16. The main pump 14 is driven by the engine 11 as described above. The main pump 14 is, for example, a variable displacement hydraulic pump, in which a regulator (not illustrated) controls the angle (tilt angle) of a swash plate to adjust the stroke length of a piston under the control performed by the controller 30 described later, so that the discharge flowrate (discharge pressure) can be controlled.

The control valve 17 is a hydraulic control device that is installed, for example, at the center of the upper turning body 3, and that controls the hydraulic drive system in accordance with an operator's operation of an operating apparatus 26. The control valve 17 is connected to the main pump 14 via the high-pressure hydraulic line 16 as described above, and hydraulic oil supplied from the main pump 14 is selectively supplied to the traveling hydraulic motors 1A (for right), 1B (for left), the turning hydraulic motor 21, the boom cylinder 7, the arm cylinder 8, and the bucket cylinder 9 according to the operating state of the operating apparatus 26. Specifically, the control valve 17 is a valve unit including multiple hydraulic control valves (directional control valves) that control the flowrates and the flow directions of hydraulic oil supplied from the main pump 14 to the respective hydraulic actuators.

The operation system of the shovel 500 according to this embodiment includes a pilot pump 15 and an operating apparatus 26.

The pilot pump 15 is installed, for example, on the rear part of the upper turning body 3, and applies a pilot pressure to the operating apparatus 26 via a pilot line 25. For example, the pilot pump 15 is a fixed displacement hydraulic pump, and is driven by the engine 11.

The operating apparatus 26 includes levers 26A and 26B, and a pedal 26C. The operating apparatus 26 is provided near the operator's seat of the cab 10, and is operation input means for operating operational elements (such as the lower traveling body 1, the upper turning body 3, the boom 4, the arm 5, and the bucket 6) by the operator. In other words, the operating apparatus 26 is operation input means for operating the hydraulic actuators (such as the traveling hydraulic motors 1A, 1B, the turning hydraulic motor 21, the boom cylinder 7, the arm cylinder 8, and the bucket cylinder 9). The operating apparatus 26 (the levers 26A and 26B, and the pedal 26C) is connected to the control valve 17 via a hydraulic line 27. The control valve 17 receives a pilot signal (pilot pressure) corresponding to the state of operation of the operating apparatus 26 for each of the lower traveling body 1, the upper turning body 3, the boom 4, the arm 5, and the bucket 6. Accordingly, the control valve 17 can drive each of the hydraulic actuators in accordance with the state of operation of the operating apparatus 26. The operating apparatus 26 is connected to the pressure sensor 29 via a hydraulic line 28. Hereinafter, the description will be given based on the assumption that the operation of the boom 4 (the boom cylinder 7) is performed by the lever 26A, and the operation of the arm 5 (the arm cylinder 8) is performed by the lever 26B.

The control system of the shovel 500 according to this embodiment includes a controller 30, a pressure sensor 29, an ECM 75, and an engine speed sensor 11*a*. The control system of the shovel 500 according to this embodiment includes, as a configuration about an operation support control explained later, an inclination angle sensor 40, a boom angle sensor 42, an arm angle sensor 44, a bucket angle sensor 46, a rod pressure sensor 48, a display apparatus 50, an audio output apparatus 52, a solenoid proportional valve 54, and an operation support function ON/OFF switch 60.

The controller 30 performs drive control of the shovel 500. The functions of the controller 30 may be achieved by any hardware or a combination of hardware and software. For example, the controller 30 is constituted by a microcomputer including a CPU (Central Processing Unit), a ROM (Read Only Memory), a RAM (Random Access Memory), a non-volatile auxiliary storage device, an I/O (Input-Output interface), and the like. Various functions are achieved by causing the CPU to execute various programs stored in the ROM and the auxiliary storage device.

For example, the controller 30 performs drive control of the engine 11 via the ECM 75 by setting a target engine speed based on a work mode or the like set in advance by a predetermined operator's operation or the like.

The controller 30 controls the hydraulic circuits for driving the hydraulic actuators including the control valve 17, on the basis of detected values of pilot pressures, received from the pressure sensor 29, corresponding to the states of operations of the operating apparatus 26 for respective operation elements (i.e., various hydraulic actuators).

Also, for example, in a case where the shovel 500 is in the jacked-up state, the controller 30 performs control for supporting an operation of an operator in order to terminate the jacked-up state (hereinafter referred to as "operation support control"). The details of the operation support control performed with the controller 30 are explained later.

Some of the functions of the controller 30 may be achieved by another controller. That is, the function of the controller 30 may be achieved as being distributed across multiple controllers.

As described above, the pressure sensor 29 is connected to the operating apparatus 26 via the hydraulic line 28, and the pressure sensor 29 detects the secondary-side pilot pressure of the operating apparatus 26, i.e., the pilot pressure corresponding to the state of operation of the operating apparatus 26 for each of the operational elements (i.e., the hydraulic actuators). A detected value of the pilot pressure, detected by the pressure sensor 29, corresponding to the state of operation of the operating apparatus 26 for each of the lower traveling body 1, the upper turning body 3, the boom 4, the arm 5, and the bucket 6 is input into the controller 30.

The ECM 75 performs drive control of the engine 11 based on the control instruction from the controller 30. For example, the ECM 75 controls the engine 11 so that the engine 11 constantly rotates at a target rotational speed corresponding to the control instruction from the controller 30, on the basis of a measured value of the rotational speed of the engine 11 corresponding to the detection signal received from the engine speed sensor 11*a*.

The engine speed sensor 11*a* is a known detection means for detecting the rotational speed of the engine 11. A detection signal corresponding to the rotational speed of the engine 11 detected by the engine speed sensor 11*a* is input into the ECM 75.

The inclination angle sensor 40 is detection means configured to detect an inclination state with reference to a predetermined reference surface of the shovel 500 (for example, a horizontal surface). For example, the inclination angle sensor 40 is mounted on the upper turning body 3, and detects an inclination angle in two axes, i.e., the longitudinal direction and the lateral direction of the shovel 500 (i.e., the upper turning body 3). A detected signal corresponding to the inclination angle detected by the inclination angle sensor 40 is input into the controller 30.

The boom angle sensor 42 detects an elevation angle of the boom 4 with reference to the upper turning body 3, for example, an angle formed by a straight line, that connects support points at both ends of the boom 4, with reference to the turning plane of the upper turning body 3 (hereinafter referred to as a "boom angle"). The boom angle sensor 42 may include, for example, a rotary encoder, an IMU (Inertial Measurement Unit), and the like. The above is also applicable to the arm angle sensor 44 and the bucket angle sensor 46 described later. A detection signal corresponding to the boom angle detected by the boom angle sensor 42 is input into the controller 30.

The arm angle sensor 44 detects an elevation angle of the arm 5 with reference to the boom 4, for example, an angle (hereinafter referred to as "arm angle") formed by a straight line, that connects support points at both ends of the arm 5, with reference to a straight line that connects support points at both ends of the boom 4 in a side view. A detection signal corresponding to the arm angle detected by the arm angle sensor 44 is input into the controller 30.

The bucket angle sensor 46 detects an elevation angle of the bucket 6 with reference to the arm 5, for example, an angle (hereinafter referred to as "bucket angle") formed by a straight line, that connects a support point and an end (i.e., the tip of the teeth) of the bucket 6, with reference to a straight line that connects support points at both ends of the arm 5 in a side view. A detected signal corresponding to the bucket angle detected by the bucket angle sensor 46 is input into the controller 30.

The rod pressure sensor 48 detects a pressure (hereinafter referred to as "rod pressure") of a rod-side hydraulic chamber 7R (see FIG. 4 and FIG. 6) of the boom cylinder 7. A detected signal corresponding to the rod pressure of the boom cylinder 7 detected by the rod pressure sensor 48 is input into the controller 30.

The display apparatus 50 is provided at a position around the operator's seat in the cab 10 so that the operator can easily see the display apparatus 50 (for example, on a pillar portion at the front right-hand side of the cab 10), and the display apparatus 50 displays various kinds of information screens under the control performed by the controller 30. The display apparatus 50 is, for example, a liquid crystal display or an organic EL (Electro Luminescence) display, or may be a touch panel type display that also serves as an operating unit. The display apparatus 50 may also include an operating unit implemented with hardware such as buttons, toggle switches, and levers for operating various operation screens related to the shovel displayed on the display unit.

The audio output apparatus 52 is provided in proximity to the operator's seat in the cab 10, and outputs the sound for notifying various notifications to the operator under the control performed by the controller 30. The audio output apparatus 52 is, for example, a speaker, a buzzer, or the like.

In the secondary-side hydraulic line 27 of the operating apparatus 26, the solenoid proportional valve 54 is provided in a secondary-side hydraulic line 27A (see FIG. 4 and FIG. 6) corresponding to a raise operation of the boom 4 corresponding to the lever 26A (hereinafter referred to as "boom-raise operation"). The solenoid proportional valve 54 reduces the pilot pressure corresponding to the operation state of the lever 26A according to a control current given by the controller 30. For example, in a case where a control current is not input to the solenoid proportional valve 54, the solenoid proportional valve 54 causes the primary-side pilot pressure of the lever 26A and the secondary-side (hydraulic line 27A) pilot pressure corresponding to raise operation of the boom 4 to be the same as each other. In a case where a control current is input to the solenoid proportional valve 54, the solenoid proportional valve 54 operates so that, as the control current increases, the secondary-side (hydraulic line 27A) pilot pressure decreases. Accordingly, the movement of the boom 4 in response to the operator's boom-raise operation can be reduced, and the movement speed can be slowed down relative to normal circumstances (i.e., circumstances in which the shovel 500 performs ordinary work such as excavation work and the like using the attachment).

The operation support function ON/OFF switch (hereinafter referred to as an "operation support function switch" for the sake of convenience) 60 is an operating unit for enabling (ON) or disabling (OFF) the function of the operation support control (hereinafter referred to as "operation support function"). The operation support function switch 60 may be, for example, an operating unit implemented with hardware such as buttons, toggle switches, and levers, which is provided with the display apparatus 50 or provided separately from the display apparatus 50, or may be, for example, an operating unit implemented with software such as icons on an operation screen displayed on the touch panel type display apparatus 50. A signal regarding the operation state of the operation support function switch 60 is input into the controller 30.

[Concrete Example of Jacked-Up State]

Figure 3A:
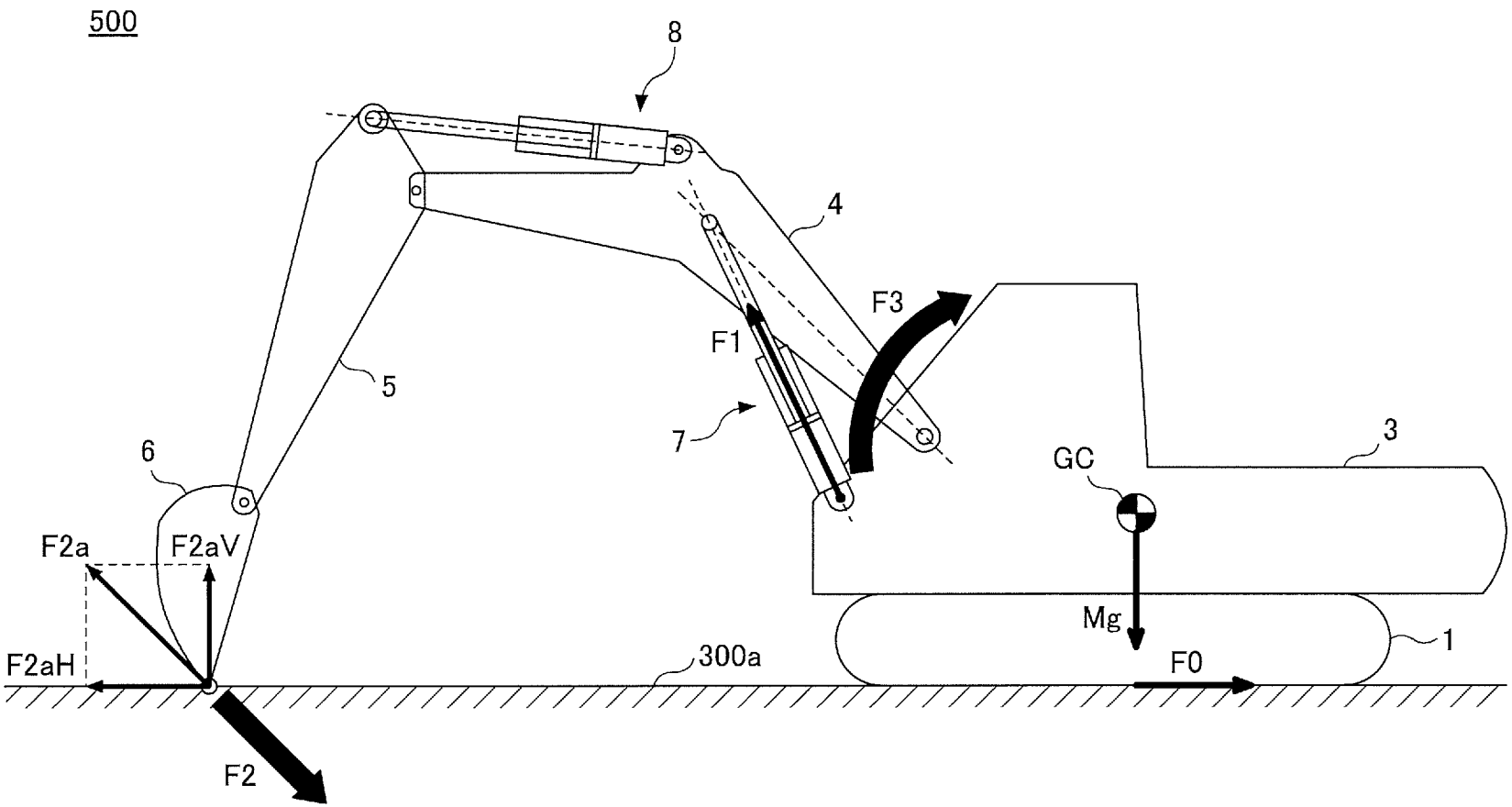
FIG. 3A is a drawing illustrating an example of a jacked-up state that occurs in the shovel.
Figure 3B:
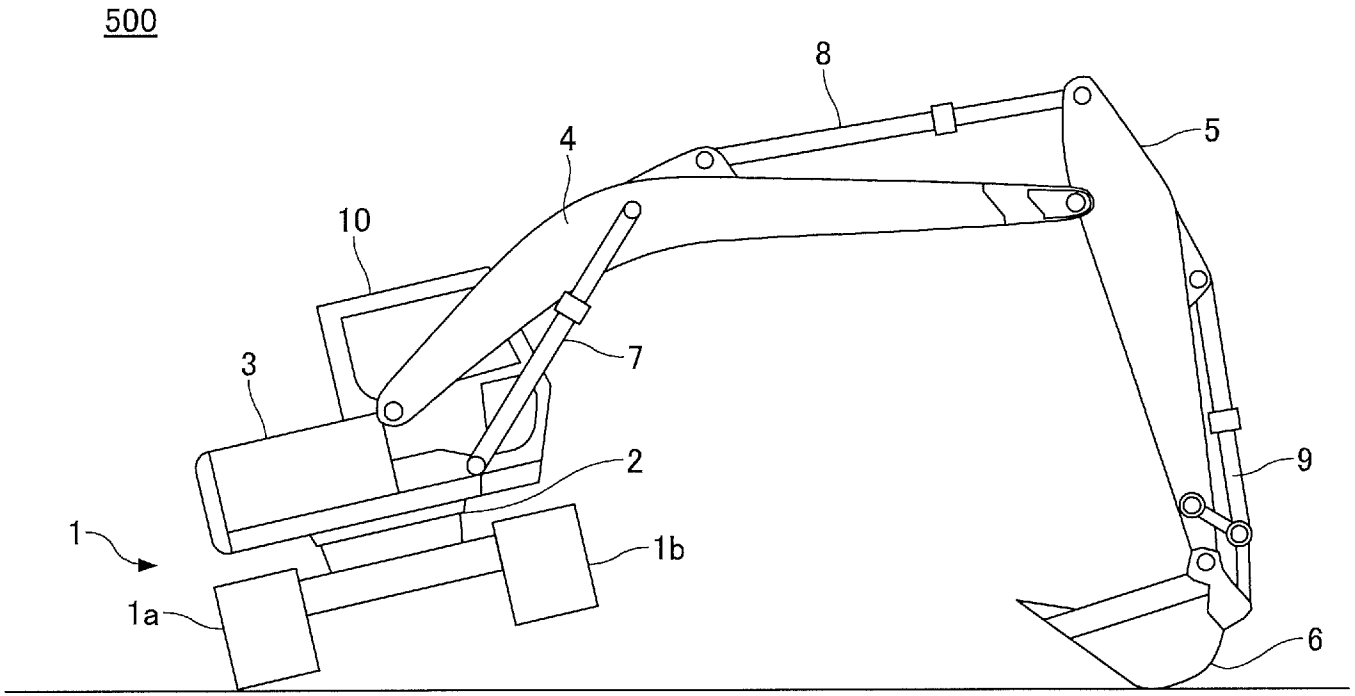
FIG. 3B is a drawing illustrating another example of a jacked-up state that occurs in the shovel.

Subsequently, an orientation state of the shovel 500 related to the operation support control, i.e., a jacked-up state, will be explained with reference to FIG. 3 (FIGS. 3A, 3B).

FIG. 3A is a drawing illustrating an example of a jacked-up state that occurs in the shovel 500. Specifically, FIG. 3A is a drawing illustrating a work situation of the shovel 500 in a jacked-up state that occurs against the operator's intention. FIG. 3B is a drawing illustrating another example of a jacked-up state that occurs in the shovel 500. Specifically, FIG. 3B is a drawing illustrating the jacked-up state of the shovel 500 that is achieved according to the operator's intention.

As illustrated in FIG. 3A, the shovel 500 is performing excavation work of the ground 300*a*, and a force F2 is exerted from the bucket 6 to the ground 300*a* in a diagonally downward direction inclined toward the vehicle body of the shovel 500, mainly due to the lowering movement of the boom 4 and the closing movement of the arm 5 and the bucket 6. In this case, a reaction force of the force F2 exerted on the bucket 6, i.e., a reaction force F3 corresponding to a vertical direction component F2*a*V of an excavation reaction force F2*a* and causing the vehicle body to incline backward (a moment of force; hereinafter simply referred to as "moment" in the present embodiment) is exerted to the vehicle body of the shovel 500 via the attachment. Specifically, the reaction force F3 is exerted on the vehicle body as a force F1 that causes the boom cylinder 7 to be raised. Then, due to this force F1, when the moment that causes the vehicle body to be inclined backward becomes more than the force (moment) that causes the vehicle body to be kept on the ground due to the gravity, a front part of the vehicle body becomes lifted. As a result, in the shovel 500, a front end portion of the bucket 6 and a rear end portion of the lower traveling body 1 are in contact with the ground, and the shovel 500 is in a jacked-up state in which the front end portion of the lower traveling body 1 is lifted.

In this manner, for example, the jacked-up state of the shovel 500 is likely to be caused against the operator's intention when the bucket 6 comes into contact with the ground while a relatively large force is applied to the bucket 6 in excavation work using the attachment.

As illustrated in FIG. 3B, the shovel 500 is in the jacked-up state in which a left-side crawler 1*b*, which is one of a right-side crawler 1*a* and the left-side crawler 1*b* of the lower traveling body 1, is lifted from the ground, and only the end portion of the bucket 6 and the right-side crawler 1*a* are in contact with the ground.

Specifically, the operator operates the operating apparatus 26 to rotate the upper turning body 3 by 90 degrees in the left direction from a state in which the upper turning body 3 faces the forward direction (the state illustrated in FIG. 1). Thereafter, the operator performs the lowering operation of the boom 4, the closing operation of the arm 5 (hereinafter referred to as a "boom lowering operation" and an "arm closing operation", respectively), and the like to cause the bucket 6 to be in contact with the ground. Then, in that state, the operator further continues the boom lowering operation, the arm closing operation, and the like to cause the left-side crawler 1*b* to be lifted from the ground. Accordingly, while the shovel 500 is in the jacked-up state, the operator operates the operating apparatus 26 to drive the left-side crawler 1*b* to be lifted off the ground, so that mud sticking to the crawler 1*b* can be dropped to the ground.

In this way, for example, when a relatively large force is applied to the ground while the bucket 6 is in contact with the ground in order to shake off the mud from the crawler of the lower traveling body 1, the jacked-up state of the shovel 500 may occur in a manner according to the operator's intention.

[Details of Operation Support Control]

Subsequently, a configuration of an operation support control apparatus 200 that performs the operation support control will be explained with reference to FIG. 4 to FIG. 6.

Figure 4:
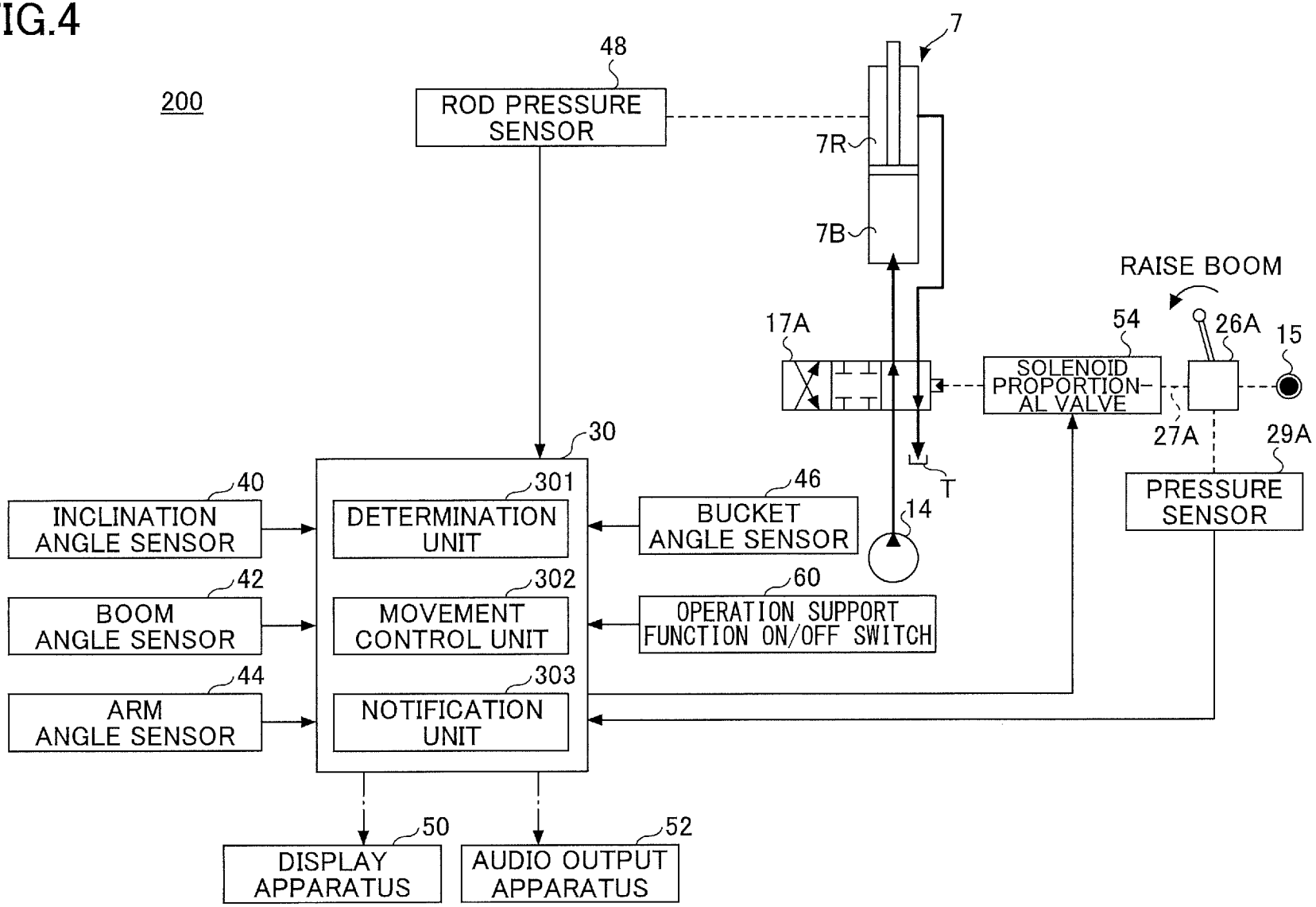
FIG. 4 is a drawing illustrating an example of configuration of an operation support control apparatus.

FIG. 4 is a drawing illustrating an example of configuration of the operation support control apparatus 200.

The operation support control apparatus 200 includes a controller 30, a pressure sensor 29 (pressure sensor 29A) configured to detect a secondary-side pilot pressure corresponding to the boom-raise operation of the lever 26A, an inclination angle sensor 40, a boom angle sensor 42, an arm angle sensor 44, a bucket angle sensor 46, a rod pressure sensor 48, a display apparatus 50, an audio output apparatus 52, a solenoid proportional valve 54, and an operation support function switch 60.

For example, the controller 30 includes a determination unit 301, a movement control unit 302, and a notification unit 303, which are functional units achieved by executing one or more programs stored in a ROM and an auxiliary storage device.

The determination unit 301 determines whether the shovel 500 is in a jacked-up state.

For example, the determination unit 301 determines whether the shovel 500 is in a jacked-up state, on the basis of the rod pressure PR of the boom cylinder 7 detected by the rod pressure sensor 48. Specifically, in a case where the rod pressure PR of the boom cylinder 7 detected by the rod pressure sensor 48 is a predetermined threshold value PRth or more, the determination unit 301 may determine that the shovel 500 is in the jacked-up state. This is because the jacked-up state of the shovel 500 is a state in which the weight of the shovel 500 is supported by the attachment, and the rod pressure of the boom cylinder 7 becomes extremely high. In this case, the predetermined threshold value PRth may be defined in advance through experiments, simulations, and the like, as a lower limit value of the rod pressure PR of the boom cylinder 7 where the shovel 500 is in the jacked-up state. Also, in a case where the rod pressure PR of the boom cylinder 7 detected by the rod pressure sensor 48 is equal to or more than the predetermined threshold value PRth continuously for a certain period of time (a predetermined period of time Tth or more), the determination unit 301 may determine that the shovel 500 is in the jacked-up state. This makes it possible to accurately distinguish between the jacked-up state and a state in which, for example, during ordinary work such as slope compaction work (compaction work) and the like, the rod pressure PR of the boom cylinder 7 becomes equal to or more than the predetermined threshold value PRth only for a moment.

Also, for example, the determination unit 301 determines whether the shovel 500 is in a jacked-up state, on the basis of the inclination state of the shovel 500 detected by the inclination angle sensor 40. This is because, as described above, in the jacked-up state, a portion of the lower traveling body 1 is lifted, and the shovel 500 (the upper turning body 3) is inclined.

Also, for example, the determination unit 301 determines whether the shovel 500 is in a jacked-up state on the basis of the operation state of the operating apparatus 26 operated by the operator with respect to the attachment. This is because, as described above, in a case where the jacked-up state of the shovel 500 occurs, a special operation is likely to be performed in which the boom lowering operation and the arm closing operation continue even after the bucket 6 has come into contact with the ground.

Also, for example, the determination unit 301 determines whether the shovel 500 is in a jacked-up state on the basis of information about the position of the bucket 6 relative to the vehicle body (i.e., the lower traveling body 1 and the upper turning body 3). In a case where the jacked-up state of the shovel 500 occurs, the position of the end portion of the bucket 6 as seen from the vehicle body is lower than a part of the lower traveling body 1 contacting the ground in normal circumstances. In this case, the determination unit 301 can measure (calculate) a relative position of the bucket 6 as seen from the vehicle body, on the basis of the boom angle, the arm angle, and the bucket angle detected by the boom angle sensor 42, the arm angle sensor 44, and the bucket angle sensor 46, respectively, and known link lengths of the boom 4, the arm 5, and the bucket 6.

Also, the determination unit 301 determines whether the shovel 500 is in the jacked-up state by using a combination of at least two or more pieces of information from among the rod pressure of the boom cylinder 7, the inclination state of the shovel 500, the operation state of the attachment, and the relative position of the bucket 6.

For example, the determination unit 301 determines whether the shovel 500 is in the jacked-up state, on the basis of information about the rod pressure of the boom cylinder 7 and at least one of information from among the inclination state of the shovel 500, the operation state of the attachment, and the relative position of the bucket 6. In this case, the determination unit 301 can refer to multiple types of information, and therefore, whether the shovel 500 is in the jacked-up state can be determined with a higher degree of accuracy.

The movement control unit 302 performs (starts) the operation support control in a case where the shovel 500 enters the jacked-up state while the operation support function is enabled (i.e., turned ON). Specifically, in a case where the shovel 500 enters the jacked-up state while the operation support function is enabled, the movement control unit 302 relatively slows down the movement of the attachment for terminating the jacked-up state of the shovel 500. Hereinafter, explanation is given based on the assumption that the operation support function is enabled.

Specifically, in a case where the shovel 500 enters the jacked-up state, the movement control unit 302 outputs a control current to the solenoid proportional valve 54. Accordingly, the secondary-side pilot pressure corresponding to a boom-raise operation of the lever 26A is reduced, the reduced pilot pressure is input to the pilot port, corresponding to the boom-raise operation, of the boom control valve 17A in the control valve 17 for driving the boom cylinder 7 (an example of a drive device).

In other words, the movement control unit 302 causes the solenoid proportional valve 54 (an example of a correction device), provided in a pressure signal path (i.e., the hydraulic line 27) corresponding to the boom-raise operation between the lever 26A and the boom control valve 17A, to correct the secondary-side pilot pressure corresponding to the boom-raise operation of the lever 26A in a direction to reduce the amount of operation. Accordingly, the flowrate of the hydraulic oil supplied through the boom control valve 17A from the main pump 14 to the bottom-side hydraulic chamber 7B of the boom cylinder 7 decreases, as compared with a boom-raise operation in normal circumstances of the lever 26A for the same amount of operation, so that the raise operation of the boom 4 is relatively slowed down. Therefore, in a case where the operator performs a boom-raise operation for terminating the jacked-up state of the shovel 500, the operation support control apparatus 200 relatively slows down the raise operation of the boom 4 to alleviate the shock that occurs when a lifted portion of the lower traveling body 1 comes into contact with the ground.

Figure 5A:
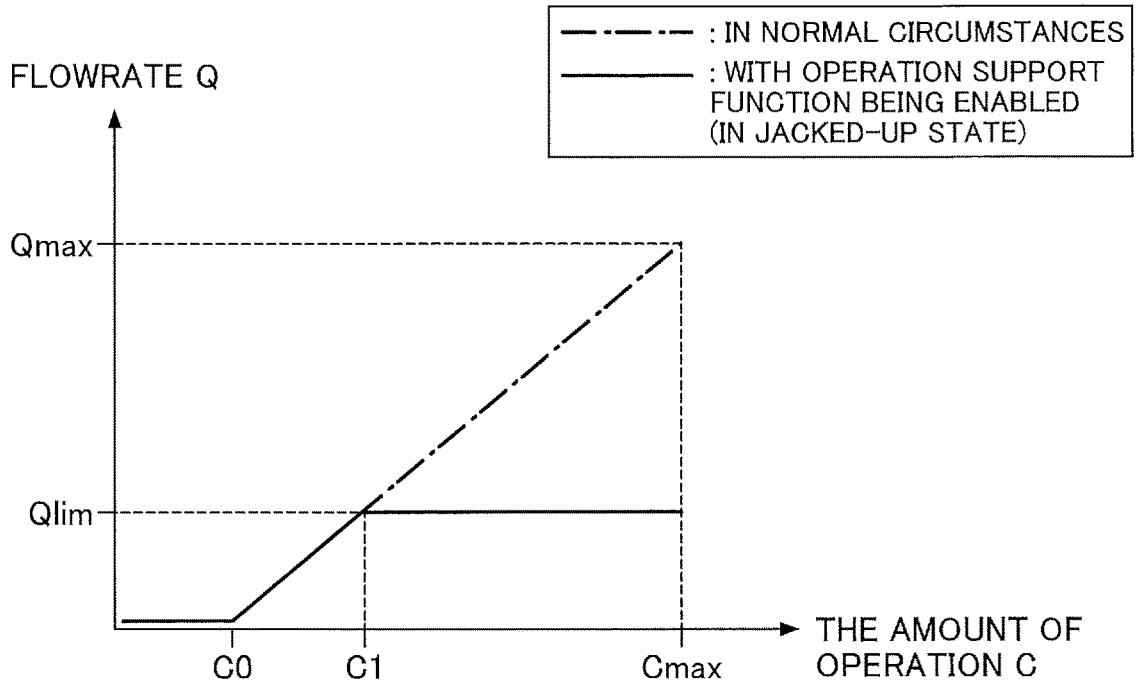
FIG. 5A is a drawing illustrating an example of a relationship between the amount of operation of a boom-raise operation and a flowrate of hydraulic oil supplied to a bottom-side hydraulic chamber of a boom cylinder.

For example, FIG. 5A is a drawing schematically illustrating a relationship between an amount C of operation of the boom-raise operation of the lever 26A and the flowrate Q of the hydraulic oil supplied to the bottom-side hydraulic chamber 7B of the boom cylinder 7.

As illustrated in FIG. 5A, in normal circumstances, the flowrate Q of the hydraulic oil supplied to the bottom-side hydraulic chamber 7B of the boom cylinder 7 increases, as a whole, in accordance with the increase in the amount C of operation. Specifically, the flowrate Q increases in a substantially linear manner in accordance with the amount C of operation except in a dead band (i.e., a range from where the amount C of operation is zero to where the amount C of operation is a predetermined value C0). Then, the flowrate Q attains a maximum flowrate Qmax in a case where the amount C of operation is a maximum value Cmax.

In contrast, in a case where the operation support control by the movement control unit 302 is started, the solenoid proportional valve 54 limits the flowrate Q such that the flowrate Q increases, as a whole, in accordance with the increase of the amount C of operation in a manner similar to normal circumstances but the flowrate Q is limited to be equal to or less than a limitation flowrate Qlim (<Qmax). Specifically, in a range in which the amount C of operation is equal to or more than a predetermined value C0, the flowrate Q increases in a substantially linear manner with the same increase rate (gradient) as the normal circumstances in accordance with the increase of the amount C of operation. However, when the amount C of operation becomes more than the predetermined value C1 corresponding to the limitation flowrate Qlim, the flowrate Q is maintained at the limitation flowrate Qlim irrespective of the amount C of operation. Accordingly, for example, even in a case where a boom-raise operation for terminating the jacked-up state is performed in a rapid manner due to a low skill level, a rough operation, or the like of the operator, the operation support control apparatus 200 can limit the flowrate Q of the hydraulic oil supplied to the bottom-side hydraulic chamber 7B of the boom cylinder 7 to a relatively low flowrate, i.e., equal to or less than the limitation flowrate Qlim at which delicate operation of the lever 26A can be performed.

Figure 5B:
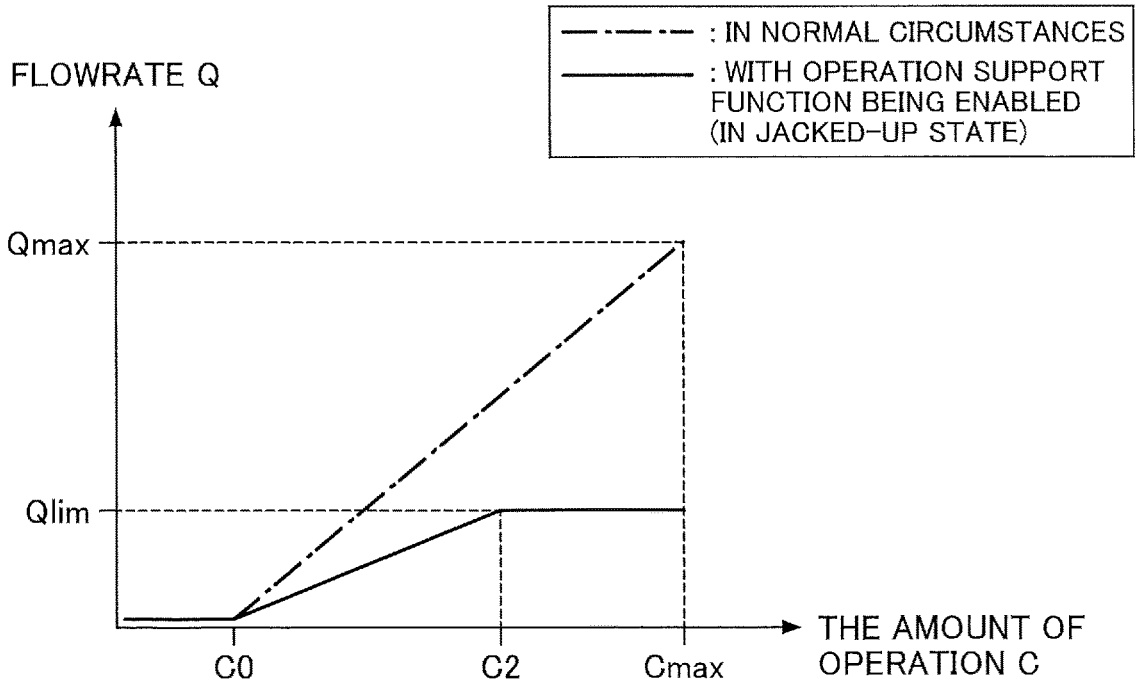
FIG. 5B is a drawing illustrating another example of a relationship between the amount of operation of a boom-raise operation and a flowrate of hydraulic oil supplied to the bottom-side hydraulic chamber of the boom cylinder.

Also, for example, FIG. 5B is a drawing schematically illustrating another example of a relationship between the amount C of operation of the boom-raise operation of the lever 26A and the flowrate Q of the hydraulic oil supplied to the bottom-side hydraulic chamber 7B of the boom cylinder 7.

As illustrated in FIG. 5B, in this example, when an operation support control by the movement control unit 302 is started, the solenoid proportional valve 54 limits the flowrate Q such that the increase rate (gradient) according to the increase of the amount C of operation is smaller than in normal circumstances, and the flowrate Q is limited to be equal to or less than the limitation flowrate Qlim. Specifically, in a range in which the amount C of operation is equal to or more than the predetermined value C0, the flowrate Q increases in a substantially linear manner in accordance with the increase of the amount C of operation with a smaller gradient (increase rate) than in normal circumstances. However, when a predetermined value C2 (>C1) corresponding to the limitation flowrate Qlim is exceeded, the flowrate Q is maintained at the limitation flowrate Qlim irrespective of the amount C of operation. Therefore, the operation support control apparatus 200 can further reduce the increase rate of the flowrate Q with respect to the increase of the amount C of operation. For this reason, in a case where the operator performs a boom-raise operation for terminating the jacked-up state of the shovel 500, the operation support control apparatus 200 can further slow down the raise operation of the boom 4, and further reduce the shock that occurs when the lower traveling body 1, a portion of which is lifted, comes into contact with the ground.

As described above, in a case where the shovel 500 is in the jacked-up state, the movement control unit 302 causes the flowrate of the hydraulic oil supplied to the bottom-side hydraulic chamber 7B of the boom cylinder 7 to be relatively smaller than in normal circumstances in accordance with the amount of operation of the boom-raise operation of the lever 26A. Accordingly, the operation support control apparatus 200 can slow down, relative to normal circumstances, the raise operation of the boom 4 corresponding to the boom-raise operation for terminating the jacked-up state of the shovel 500, and reduce the shock that occurs in the vehicle body (i.e., the lower traveling body 1 and the upper turning body 3) when the jacked-up state is terminated. Therefore, as a result, the operation support control apparatus 200 can reduce the degradation of the vehicle body, noises to the surroundings, uncomfortableness of the operator, and the like, which are caused when the jacked-up state is terminated. Also, in a case where the shovel 500 is operated by an operator whose operational skill is relatively low, the operation support control apparatus 200 can suppress the shock that occurs when the jacked-up state of the shovel 500 is terminated. Also, even in a case of an operator with a high operational skill being required to perform delicate operation to prevent shock to the vehicle body, the operation support control apparatus 200 can reduce the shock that occurs in the vehicle body when the jacked-up state is terminated, without requiring the operator to take greater attentions than necessary, and as a result, the fatigue of the operator can be alleviated.

Also, according to other methods, the movement control unit 302 may reduce, relative to normal circumstances, the flowrate of the hydraulic oil supplied to the boom cylinder 7 in accordance with the amount of operation of the boom-raise operation of the lever 26A. Hereinafter, such other methods will be explained with reference to FIG. 6.

Figure 6:
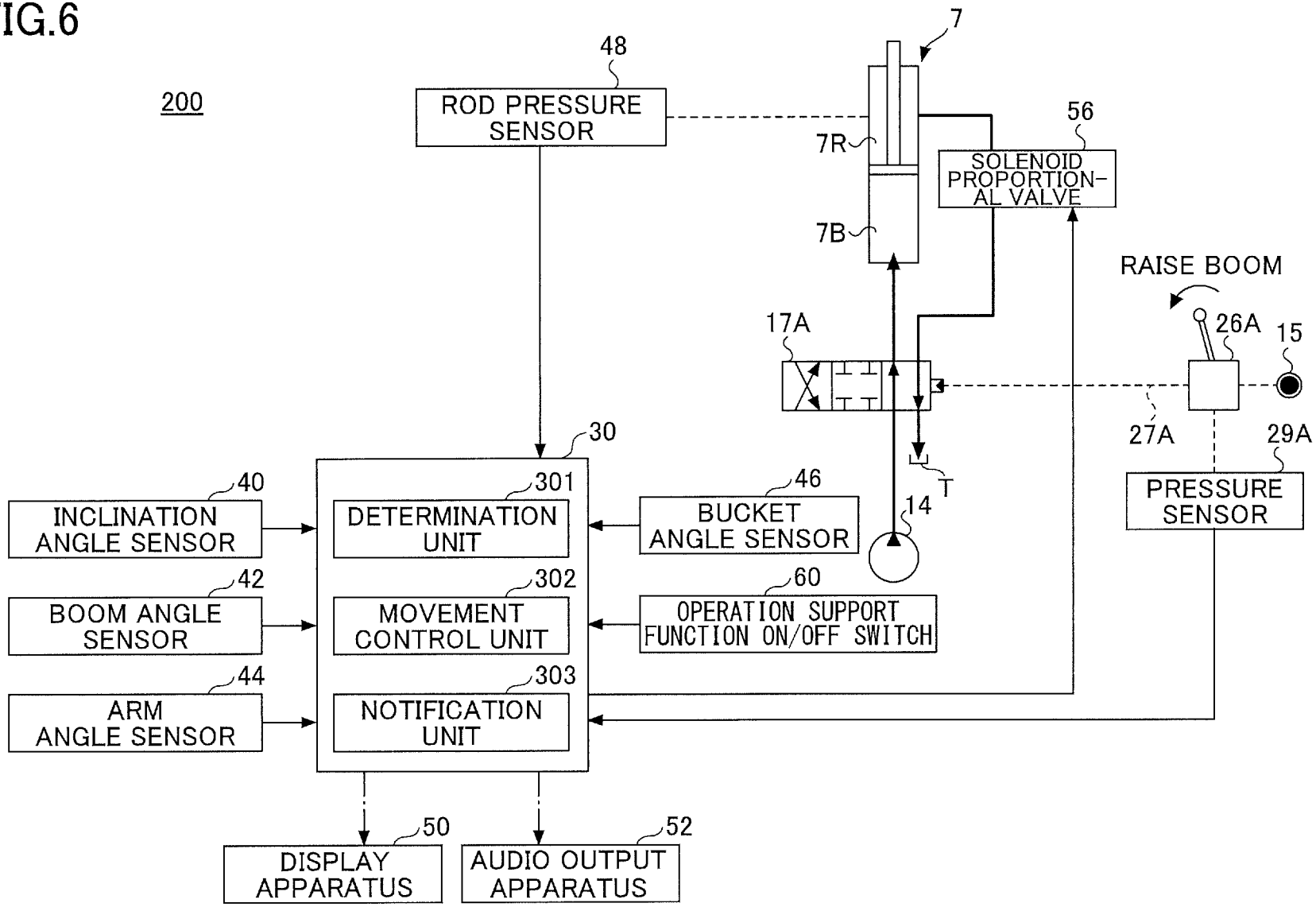
FIG. 6 is a drawing illustrating another example of configuration of the operation support control apparatus.

FIG. 6 is a drawing illustrating another example of a configuration of the operation support control apparatus 200.

In this example, unlike the case of FIG. 4, the operation support control apparatus 200 includes a solenoid proportional valve 56 instead of the solenoid proportional valve 54.

The solenoid proportional valve 56 is provided in a high-pressure hydraulic line between the rod-side hydraulic chamber 7R of the boom cylinder 7 and the boom control valve 17A. Specifically, the solenoid proportional valve 56 is provided in a discharge path of the hydraulic oil from the rod-side hydraulic chamber 7R through the boom control valve 17A to a hydraulic oil tank T when a boom-raise operation is performed with the lever 26A. The solenoid proportional valve 56 limits the flowrate discharged from the rod-side hydraulic chamber 7R of the boom cylinder 7 during the boom-raise operation of the lever 26A in accordance with the control current given by the controller 30. For example, in a case where a control current is not input to the solenoid proportional valve 56, the solenoid proportional valve 56 does not limit the flowrate, and in a case where a control current is input to the solenoid proportional valve 56, the solenoid proportional valve 56 operates so that the permitted flowrate decreases as the control current increases. Therefore, as a result, the solenoid proportional valve 56 can limit the flowrate supplied to the bottom-side hydraulic chamber 7B of the boom cylinder 7 when the boom-raise operation is performed with the lever 26A.

In a case where the shovel 500 enters the jacked-up state, the movement control unit 302 outputs a control current to the solenoid proportional valve 56. Therefore, when the boom-raise operation is performed with the lever 26A, the flowrate of the hydraulic oil discharged from the rod-side hydraulic chamber 7R of the boom cylinder 7 is limited, and as a result, the flowrate of the hydraulic oil supplied to the bottom-side hydraulic chamber 7B is limited. In this case, for example, the relationship between the flowrate and the amount of operation illustrated in FIGS. 5A, 5B explained above may be employed as the limitation of the flowrate achieved by the solenoid proportional valve 56.

Also, in this example, the movement control unit 302 uses the solenoid proportional valve 56 to limit the flowrate of the hydraulic oil discharged from the rod-side hydraulic chamber 7R of the boom cylinder 7 when the boom-raise operation is performed with the lever 26A, but alternatively, the movement control unit 302 may directly limit the flowrate of the hydraulic oil supplied to the bottom-side hydraulic chamber 7B. In this case, the solenoid proportional valve 56 is provided in a high-pressure hydraulic line between the bottom-side hydraulic chamber 7B of the boom cylinder 7 and the boom control valve 17A.

In other words, the movement control unit 302 causes the solenoid proportional valve 56 (an example of an adjustment valve) to adjust the flowrate of the hydraulic oil supplied to the bottom-side hydraulic chamber 7B of the boom cylinder 7 or discharged from the rod-side hydraulic chamber 7R so that the flowrate becomes relatively less than in normal circumstances. Accordingly, the flowrate of the hydraulic oil supplied from the main pump 14 through the boom control valve 17A to the bottom-side hydraulic chamber 7B of the boom cylinder 7 decreases as compared with a boom-raise operation in normal circumstances performed with the lever 26A for the same amount of operation, so that the raise operation of the boom 4 is relatively slowed down. Therefore, like the case of the example illustrated in FIG. 4, in a case where the operator performs the boom-raise operation for terminating the jacked-up state of the shovel 500, the operation support control apparatus 200 can relatively slow down the raise operation of the boom 4, and can alleviate the shock that occurs when a lifted portion of the lower traveling body 1 comes into contact with the ground.

Back to FIG. 4, in a case where the operation support control explained above is started, the notification unit 303 controls the display apparatus 50 and the audio output apparatus 52 to notify, by way of the display apparatus 50 and the audio output apparatus 52, the operator that the operation support control has been started. Hereinafter, the notification is referred to as an "operation support control start notification" for the sake of convenience. In other words, the notification unit 303 notifies the operator that, with the operation support function, the movement of the attachment for terminating the jacked-up state in response to the operation of the operating apparatus 26 operated by the operator is slowed down relative to normal circumstances. Therefore, the operator can recognize that the movement of the attachment in response to the operation of the operating apparatus 26 is slower than in normal circumstances.

Also, in a case where the operation support control is stopped after the operation support control is started, the notification unit 303 controls the display apparatus 50 and the audio output apparatus 52 to notify, by way of the display apparatus 50 and the audio output apparatus 52, the operator that the operation support control has been stopped. Hereinafter, the notification will be referred to as an "operation support control stop notification" for the sake of convenience. In other words, the notification unit 303 notifies the operator that, with the operation support function, a state in which the movement of the attachment for terminating the jacked-up state in response to the operation of the operating apparatus 26 operated by the operator is slowed down relative to normal circumstances has been canceled. Therefore, the operator can recognize that the state in which the movement of the attachment in response to the operation of the operating apparatus 26 is slower than in normal circumstances has been canceled.

[Setting Method for Operation Support Control Apparatus]

Subsequently, a concrete example of a setting method for the operation support control apparatus 200 will be explained with reference to FIG. 7.

Figure 7:
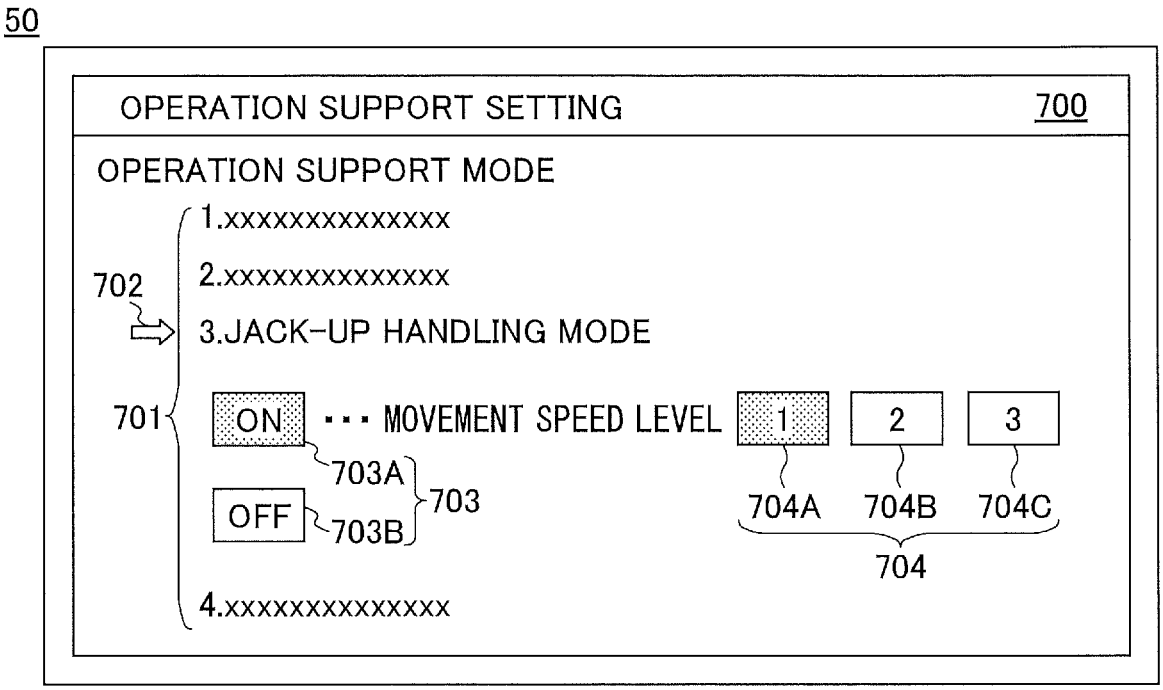
FIG. 7 is a drawing illustrating an example of a setting screen for the operation support control apparatus.

FIG. 7 is a drawing illustrating an example of a setting screen (i.e., a setting screen 700) for the operation support control apparatus 200 displayed on the display apparatus 50.

As illustrated in FIG. 7, the setting screen 700 includes a list 701, a selection icon 702, an ON/OFF icon 703, and a movement speed selection icon 704.

The list 701 represents control modes (operation support modes) for multiple operation support controls which are to be set. In this example, the list 701 includes four operation support modes including an operation support mode (jack-up handling mode) for handling the jacked-up state of the shovel 500 according to the present embodiment. With predetermined operation means (for example, buttons and the like on the display apparatus 50, a touch panel and the like implemented in the display apparatus 50, and the like), an operator and the like can select a desired operation support mode from among the control modes of the multiple operation support controls.

The selection icon 702 represents a currently selected operation support mode which is to be set. This example indicates that the jack-up handling mode is selected.

When the jack-up handling mode is not selected, the ON/OFF icon 703 and the movement speed selection icon 704 may be configured to be in a hidden state, i.e., a folded state, and when the jack-up handling mode is selected, the ON/OFF icon 703 and the movement speed selection icon 704 may be configured to be expanded and displayed.

The ON/OFF icon 703 is a virtual operation target corresponding to the operation support function switch 60. The ON/OFF icon 703 includes an ON icon 703A and an OFF icon 703B, and in this example, the ON icon 703A is in the selected state. The operator and the like perform an operation for designating the ON icon 703A or the OFF icon 703B by using the predetermined operation means, so that the operator and the like can enable or disable the jack-up handling mode, i.e., the function of the operation support control for handling the jacked-up state of the shovel 500 explained above.

The movement speed selection icon 704 is a virtual operation target for setting a movement speed of the attachment during operation support in the jack-up handling mode, i.e., a movement speed of the attachment to which the shovel 500 relatively slows down in accordance with the jacked-up state. In this example, the movement speed of the attachment during the jacked-up state of the shovel 500 is divided into three levels, and the movement speed selection icon 704 includes level icons 704A to 704C. In this example, the level icon 704A is selected. The operator and the like perform an operation for designating any one of the level icons 704A to 704C by using the predetermined operation means, so that the movement speed of the attachment during the jacked-up state of the shovel 500 can be set from among the three levels.

[Operation of Operation Support Control Apparatus]

Subsequently, the details of operation performed by the operation support control apparatus 200 will be explained with reference to FIG. 8 and FIG. 9.

Figure 8:
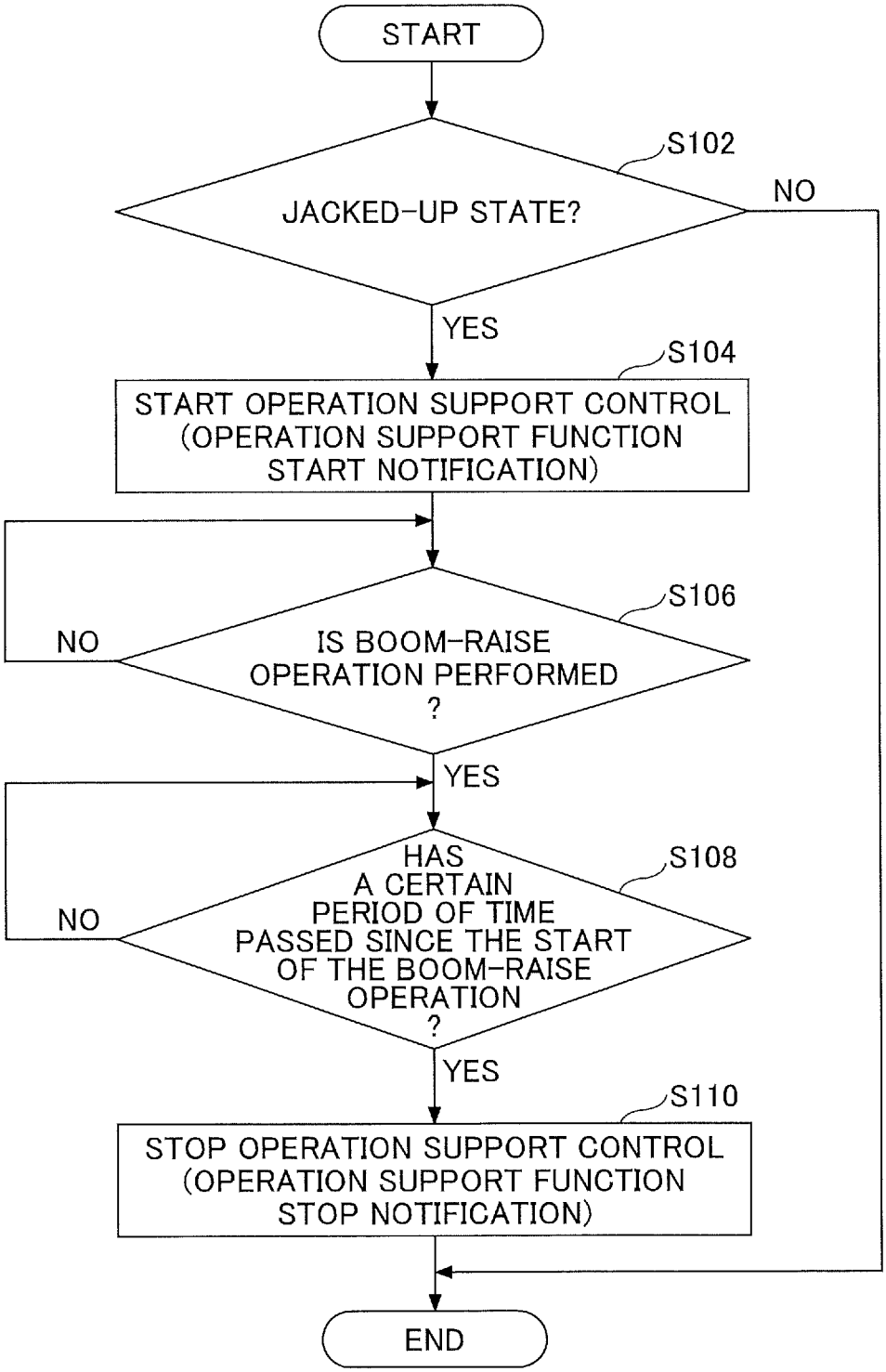
FIG. 8 is a flowchart schematically illustrating an example of an operation support control process performed by the operation support control apparatus.

FIG. 8 is a flowchart schematically illustrating an example of an operation support control process performed by the controller 30 of the operation support control apparatus 200. The process according to this flowchart is repeatedly executed with a predetermined process interval, in a case where, for example, the operation support function is turned ON (enabled) and the operation support control is not executed while the shovel 500 is operating. This is also applicable to the flowchart of FIG. 9 explained later.

In step S102, the determination unit 301 determines whether the shovel 500 is in a jacked-up state. In a case where the shovel 500 is in the jacked-up state, the determination unit 301 proceeds to step S104, and in a case where the shovel 500 is not in the jacked-up state, the determination unit 301 terminates the current process.

In step S104, the movement control unit 302 starts the operation support control. Specifically, the movement control unit 302 starts the output of the control current to the solenoid proportional valve 54 or the solenoid proportional valve 56. Then, by way of the display apparatus 50 and/or the audio output apparatus 52, the notification unit 303 notifies an operation support control start notification to the operator.

In step S106, the movement control unit 302 determines whether the boom-raise operation is performed with the lever 26A, on the basis of the detected signal of the pressure sensor 29A. In a case where the boom-raise operation is performed, the movement control unit 302 proceeds to step S108, and in a case where the boom-raise operation is not performed, the movement control unit 302 repeats the process of this step until the boom-raise operation is performed.

In a case where the boom-raise operation is not performed even after a relatively long period of time has elapsed since the process start in step S106, the process according to this flowchart may be forcibly stopped. This is because there is a possibility that the jacked-up state may not have occurred, for example, depending on the accuracy for determining the jacked-up state by the determination unit 301.

In step S108, the movement control unit 302 determines whether a certain period of time determined in advance has elapsed since the start of the boom-raise operation. For example, the certain period of time may be determined in advance, through experiments and computer simulations, as the upper limit value (the maximum value) of the time required from when the boom-raise operation for terminating the jacked-up state of the shovel 500 is started to when the jacked-up state is actually terminated. In a case where the certain period of time has elapsed since the start of the boom-raise operation, the movement control unit 302 proceeds to step S110. In a case where the certain period of time has not yet elapsed since the start of the boom-raise operation, the movement control unit 302 waits until the certain period of time elapses (i.e., repeats the process of this step).

In step S110, the movement control unit 302 stops the operation support control. Specifically, the output of the control current to the solenoid proportional valve 54 or the solenoid proportional valve 56 is stopped. Then, by way of the display apparatus 50 and/or the audio output apparatus 52, the notification unit 303 notifies an operation support control stop notification to the operator.

As described above, in this example, in a case where the operation support control apparatus 200 determines that the shovel 500 is in the jacked-up state, the operation support control apparatus 200 slows down, relative to normal circumstances, the operation of the attachment for terminating the jacked-up state of the shovel 500 (i.e., the raise operation of the boom 4). Then, in a case where a certain period of time has elapsed since the operation of the attachment for terminating the jacked-up state of the shovel 500 is started, the operation support control apparatus 200 returns the movement speed of the attachment back to the original state. Therefore, because the certain period of time is set as appropriate, the operation support control apparatus 200 slows down, relative to normal circumstances, the operation of the attachment for terminating the jacked-up state of the shovel 500 until the jacked-up state of the shovel 500 is terminated. Therefore, the operation support control apparatus 200 can reduce the shock that occurs in the vehicle body when a lifted portion of the lower traveling body 1 comes into contact with the ground when the jacked-up state is terminated. Also, because the certain period of time is set as appropriate, the operation support control apparatus 200 can prevent, unnecessarily continuing to slow down the operation of the attachment with respect to normal circumstances even though the jacked-up state of the shovel 500 has been terminated.

Figure 9:
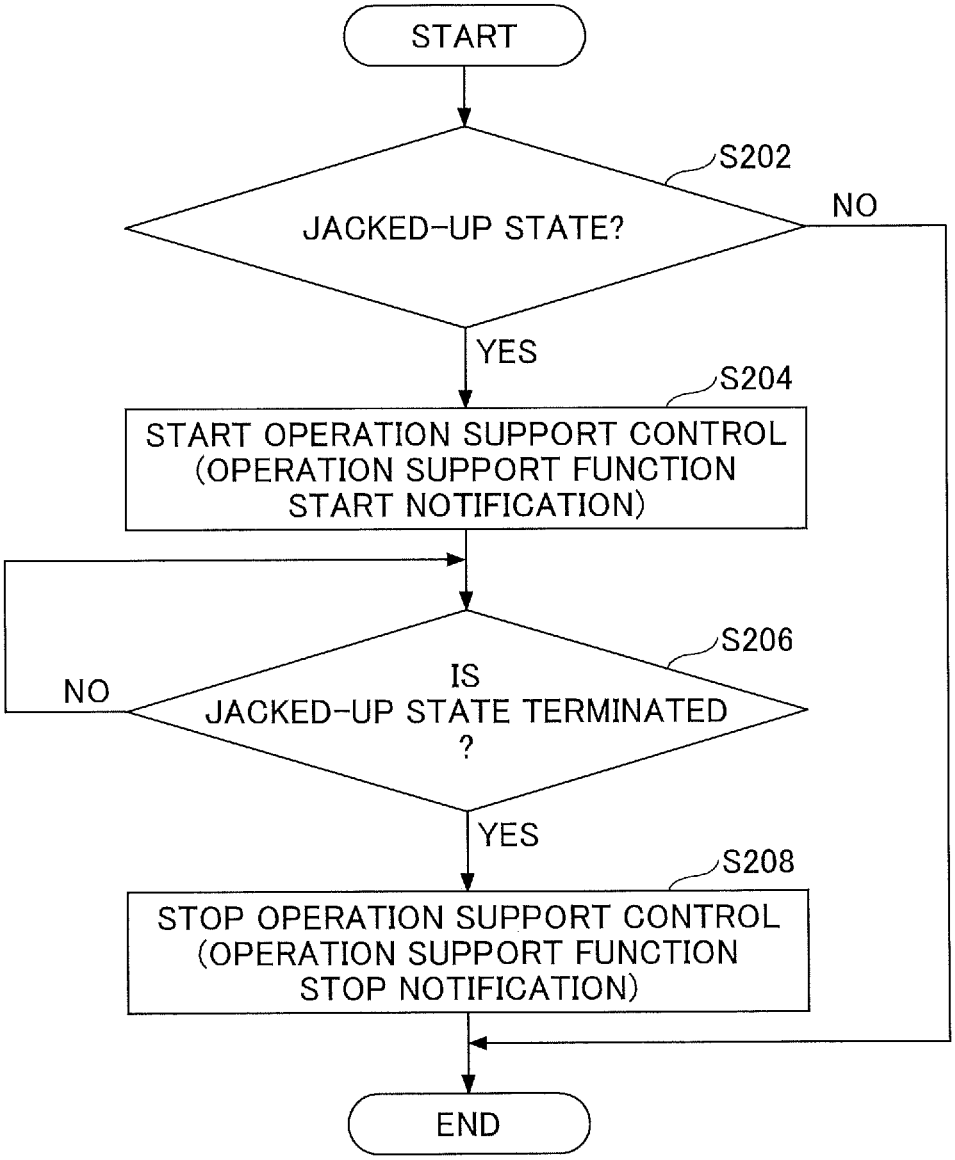
FIG. 9 is a flowchart schematically illustrating another example of an operation support control process performed by the operation support control apparatus.

Subsequently, FIG. 9 is a flowchart schematically illustrating another example of an operation support control process performed by the controller 30 of the operation support control apparatus 200.

Because the processes of steps S202, S204 are the same as steps S102, S104 of FIG. 8, explanation thereabout is omitted.

In step S206, the determination unit 301 determines whether the jacked-up state of the shovel 500 has been terminated. In a case where the jacked-up state of the shovel 500 has been terminated, i.e., the shovel is no longer in the jacked-up state, the determination unit 301 proceeds to step S208. Conversely, in a case where the jacked-up state of the shovel 500 has not been terminated, i.e., the shovel is still in the jacked-up state, the determination unit 301 waits until the jacked-up state of the shovel 500 has been terminated (i.e., repeats the process in this step).

In a case where the jacked-up state is not terminated even after a relatively long period of time has elapsed since the process start in step S206, the process according to this flowchart may be forcibly stopped. This is because there is a possibility that the jacked-up state may not have occurred, for example, depending on the accuracy for determining the jacked-up state by the determination unit 301.

Because the process of step S208 is the same as step S110 of FIG. 8, explanation thereabout is omitted.

As described above, in this example, in a case where the operation support control apparatus 200 determines that the shovel 500 is in the jacked-up state, the operation support control apparatus 200 slows down, relative to normal circumstances, the operation of the attachment for terminating the jacked-up state of the shovel 500 (i.e., the raise operation of the boom 4). Then, in a case where the operation support control apparatus 200 thereafter determines that the jacked-up state of the shovel 500 has been terminated, the operation support control apparatus 200 returns the movement speed of the attachment back to the original state. Therefore, the operation support control apparatus 200 can specifically find the timing at which the jacked-up state of the shovel 500 has been terminated, and return the movement speed of the attachment back to the original state. Therefore, the operation support control apparatus 200 can more reliably prevent unnecessarily continuing to slow down the operation of the attachment with respect to normal circumstances.

Although the embodiment for carrying out the present invention has been described in detail above, the present invention is not limited to such a specific embodiment, and various modifications and changes can be made within the scope of the gist of the present invention described in the claims.

For example, in the embodiment explained above, the operating apparatus 26 is of a hydraulic type which outputs a hydraulic pressure signal (pilot pressure) according to the operation state by the operator, but the operating apparatus 26 may be an electric type which outputs an electric signal. In this case, the control valve 17 is configured in such a manner as to include an electromagnetic pilot-type hydraulic control valve (for example, an electromagnetic pilot-type boom control valve 17A) driven by an electric signal according to an operation state received directly from the operating apparatus 26 or indirectly via the controller 30. Also, the solenoid proportional valve 54 is replaced with an electric circuit and a process device (both of which are examples of a correction device) for correcting an electric signal corresponding to the boom-raise operation of the lever 26A according to a control instruction given by the controller 30 (i.e., the movement control unit 302) and outputs the electric signal to the boom control valve 17A. The functions of the electric circuit and the process device may be provided in the controller 30.

Also, for example, in the embodiment and modification explained above, as the operation of the attachment for terminating the jacked-up state of the shovel 500, the movement control unit 302 slows down, relative to normal circumstances, the raise operation of the boom 4, but the present invention is not limited thereto. For example, as the operation of the attachment for terminating the jacked-up state of the shovel 500, the movement control unit 302 may slow, relative to normal circumstances, an opening operation of the arm 5 in place of or in addition to the raise operation of the boom 4. In this case, for example, like the solenoid proportional valve 54, a solenoid proportional valve for reducing the secondary-side pilot pressure corresponding to the arm opening operation of the lever 26B under the control performed by the controller 30 may be provided in the hydraulic line 27 between the control valve 17 and the output port corresponding to the arm opening operation of the lever 26B. Also, for example, like the solenoid proportional valve 56, a solenoid proportional valve for limiting the flowrate of the hydraulic oil discharged from the bottom-side hydraulic chamber of the arm cylinder 8 during the arm opening operation of the lever 26B under the control performed by the controller 30 may be provided in the high-pressure hydraulic line between the control valve 17 and the bottom-side hydraulic chamber of the arm cylinder 8. Also, for example, a solenoid proportional valve for limiting the flowrate of the hydraulic oil supplied to the rod-side hydraulic chamber of the arm cylinder 8 during the arm opening operation of the lever 26B under the control performed by the controller 30 may be provided in the high-pressure hydraulic line between the control valve 17 and the rod-side hydraulic chamber of the arm cylinder 8.

Also, in the embodiment and modifications explained above, in a case where the shovel 500 is in the jacked-up state, the operation support control apparatus 200 slows down, relative to normal circumstances, only the operation of the attachment for terminating the jacked-up state of the shovel 500, but the present invention is not limited thereto. For example, the operation support control apparatus 200 may slow, relative to normal circumstances, all of the operations of the attachment in a case where the shovel 500 is in the jacked-up state. In this case, for example, the operation support control apparatus 200 (i.e., the controller 30) may slow, relative to normal circumstances, all of the operations of the attachment by limiting the discharge flow-rate of the main pump 14 and limiting the output of the engine 11 which is a source for driving the main pump 14.

Also, in the embodiment and modifications explained above, the operation support control apparatus 200 determines whether the shovel 500 is in the jacked-up state on the basis of the rod pressure PR and the like of the boom cylinder 7, but the present invention is not limited thereto. For example, the operation support control apparatus 200 may slow the movement speed of the attachment such as the boom cylinder 7 in a case where the rod pressure PR of the boom cylinder 7 becomes relatively high (specifically, in a case where the rod pressure PR becomes equal to or more than the predetermined threshold value PRth) irrespective of whether the shovel 500 is in the jacked-up state. Also, the operation support control apparatus 200 may slow the movement speed of the attachment such as the boom cylinder 7 in a case where the rod pressure PR of the boom cylinder 7 is high continuously for a relatively long period of time (i.e., the rod pressure PR is equal to or more than the predetermined threshold value PRth continuously for a predetermined period of time Tth or more). In this case, the operation support control apparatus 200 may execute the process flow of FIG. 8 modified in such a manner that, in step S102, a process for determining as to whether the rod pressure PR of the boom cylinder 7 has become relatively high or a process for determining as to whether the rod pressure PR is relatively high continuously for a relatively long period of time is employed instead of determining the jacked-up state. Also, the operation support control apparatus 200 may execute the process flow of FIG. 9 modified in such a manner that, in step S202, a process for determining as to whether the rod pressure PR of the boom cylinder 7 has become relatively high or a process for determining as to whether the rod pressure PR is relatively high continuously for a relatively long period of time is employed instead of determining whether the shovel 500 is in the jacked-up state and, in step S206, a process for determining as to whether a state in which the rod pressure PR of the boom cylinder 7 is relatively high has been terminated is employed instead of determining whether the jacked-up state has been terminated.

Also, in the embodiment and modifications explained above, the operation support control apparatus 200 adjusts the movement speed of the attachment such as the boom cylinder 7 in a case where the shovel 500 is in the jacked-up state, but the present invention is not limited thereto. For example, the operation support control apparatus 200 may adjust the movement speed of the attachment in order to handle a change in the counter weight mounted on the upper turning body 3 of the shovel 500 (i.e., multiple types of counter weights that can be mounted on the shovel 500). In this case, the operation support control apparatus 200 may automatically determine the mounted counter weight, and automatically adjust the movement speed of the attachment. Also, in accordance with a manual setting of the counter weight that is set by the operator and the like, the operation support control apparatus 200 may automatically adjust the movement speed of the attachment, or in accordance with a manual setting of the movement speed that is set by the operator and the like, the operation support control apparatus 200 may adjust the movement speed of the attachment. Also, like the embodiment explained above, the manual setting may be set by the operator using an operating unit implemented with hardware such as buttons, toggle switches, and levers, or an operating unit implemented with software such as, for example, icons and the like on an operation screen displayed on the touch panel type display apparatus 50 (for example, the setting screen 700 of FIG. 7 explained above).

Also, in the embodiment and modifications explained above, in a case where the shovel 500 is in the jacked-up state, the operation support control apparatus 200 may not only relatively slow the movement speed of the attachment (i.e., the boom 4 and the arm 5) but also automatically terminate the jacked-up state of the shovel 500. In other words, in a case where the shovel 500 is in the jacked-up state, the operation support control apparatus 200 may automatically terminate the jacked-up state while relatively slowing down the movement speed of the attachment. Accordingly, the jacked-up state of the shovel 500 is automatically terminated. Also, in a case where the shovel 500 is in the jacked-up state, the operation support control apparatus 200 determines whether the shovel 500 is in a jacked-up state as intended by the operator and the like or in a jacked-up state not intended by the operator and the like, and when the shovel 500 is in a not-intended jacked-up state, the operation support control apparatus 200 may automatically terminate the jacked-up state while relatively slowing down the movement speed of the attachment. For example, the operation support control apparatus 200 can determine whether the current jacked-up state is intended or not intended by finding the work situation of the shovel 500 immediately before the current jacked-up state on the basis of the operation state and the like of the operating apparatus 26. Accordingly, in a case where the operator and the like intentionally made the shovel 500 into the jacked-up state (for example, in the case of FIG. 3B explained above), the operation support control apparatus 200 may prevent the jacked-up state of the shovel 500 from being automatically terminated. Also, when an operation for terminating the jacked-up state of the shovel 500 is performed in a case where the shovel 500 is in the jacked-up state, the operation support control apparatus 200 may automatically terminate the jacked-up state of the shovel 500 while slowing down the movement speed of the attachment. For example, an operation for terminating the jacked-up state of the shovel 500 is an operation of the operating apparatus 26 to raise the boom 4 or an operation of the operating apparatus 26 to open the arm 5. In this case, the movement speed of the attachment is controlled irrespective of the content of operation (i.e., the amount of operation) of the operating apparatus 26 with respect to the boom 4 and the arm 5. Also, the operation for terminating the jacked-up state of the shovel 500 may be an operation of a dedicated operation button and the like for terminating the jacked-up state. Accordingly, only when the operator and the like has an intention to terminate the jacked-up state, the operation support control apparatus 200 can automatically terminate the jacked-up state of the shovel 500.

Also, in the embodiment and modifications explained above, the shovel 500 operates by receiving, by way of the operating apparatus 26, an operation performed by the operator and the like who rides the cab 10, but the present invention is not limited thereto. For example, the shovel 500 sequentially transmits, to an external device, images captured by an image-capturing device which captures the images in the surroundings and which is communicably connected to a predetermined external device via a communication network (for example, mobile communication networks having base stations as terminal stations, satellite communication networks using communication satellites, the Internet, and the like) by using an onboard communication device. This allows the worker and the like to check the situation in the surroundings of the shovel 500 with the external device. Then, the shovel 500 may operate by receiving, via the communication network, an operation input on operation means (for example, a joy stick and the like) of the external device by a worker (i.e., an operator) and the like with the external device. In other words, the shovel 500 may be remotely operated via the communication network. In this case, like the embodiment explained above, the operation support control apparatus 200 can support the operation of the operator and the like via the communication network. In other words, even in a case where a jacked-up state of the shovel 500 against the operator's intention (see FIG. 3A) or a jacked-up state of the shovel 500 according to the operator's intention (see FIG. 3B) occurs as a result of remote operation, the operation support control apparatus 200 can perform an operation support control similar to the embodiment and the modifications explained above.

Also, in the embodiment and the modifications explained above, the shovel 500 operates by receiving an operation performed by the operator and the like, but alternatively, the shovel 500 may autonomously operate without receiving an operation from the outside. In this case, instead of an operation content (for example, the direction of operation and the amount of operation) of the operating apparatus 26 performed by the operator and the like, the shovel 500 operates according to an operation content automatically generated by a control apparatus controlling autonomous operation (hereinafter referred to as an autonomous control apparatus). In other words, the shovel 500 is automatically operated by the autonomous control apparatus. Also, as described above, in a case where the shovel 500 is autonomously operated, the operation support control apparatus 200 can support automatic operation of the shovel 500 by the autonomous control apparatus. In other words, even in a case where a jacked-up state of the shovel 500 against the operator's intention (see FIG. 3A) or a jacked-up state of the shovel 500 according to the operator's intention (see FIG. 3B) occurs as a result of automatic operation of the shovel 500 performed by the autonomous control apparatus, the operation support control apparatus 200 can perform an operation support control similar to the embodiment and modifications explained above.

Also, in the embodiment and modifications explained above, the shovel 500 is configured to hydraulically drive all of the various operation elements such as the lower traveling body 1, the upper turning body 3, the boom 4, the arm 5, the bucket 6, and the like, but alternatively, some of the operation elements may be configured to be electrically driven. The configuration and the like disclosed in the embodiment explained above may be applied to a hybrid shovel, an electric shovel, and the like.

According to the embodiment explained above, a shovel capable of reducing a shock that occurs in a vehicle body in a case where a jacked-up state is terminated can be provided.

What is claimed is:

1. A shovel comprising:

a traveling body;

a turning, body turnably mounted on the traveling body;

an attachment attached to the turning body and including a boom an arm, and a bucket;

an operating apparatus for operating the boom; and a processor, wherein the processor is configured to determine whether the shovel is in a state in which the traveling body is lifted, on the basis of a pressure of a rod-side hydraulic chamber of a boom cylinder for driving the boom, wherein the processor is configured to relatively slow down an operation of the attachment in such a direction as to terminate the state in which the traveling body is lifted in response to determining that the shovel is in the state in which the traveling body is lifted, wherein a flowrate of hydraulic oil supplied to the boom cylinder to drive the boom increases in accordance with an increase of an amount of operation of the operating apparatus, and wherein the processor is configured to relatively reduce the flowrate of the hydraulic oil supplied to the boom cylinder in accordance with the amount of operation in a direction to raise the boom, in response to determining that the shovel is in the state in which the traveling body is lifted.

2. The shovel according to claim 1, wherein the state in which the traveling body is lifted is a state in which the bucket comes into contact with a ground with a relatively large force being applied or a relatively large force is applied to the ground with the bucket being in contact with the ground, so that a portion of the traveling body is lifted from the ground, and a weight of the shovel is supported by the traveling body and the attachment.

3. The shovel according to claim 1, wherein the processor is configured to determine whether the shovel is in the state in which the traveling body is lifted, further on the basis of at least one of information from among information about an inclination state of the shovel, information about a position of the bucket, and information about an operation state of the attachment.

4. The shovel according to claim 1, further comprising:

a control valve configured to hydraulically drive the boom cylinder on the basis of an output signal corresponding to the amount of operation, the output signal being output from the operating apparatus; and a correction device provided in a signal transmission path between the operating apparatus and the control valve and capable of correcting the output signal under a control of the processor and outputting the output signal to the control valve, wherein in the state in which the traveling body is lifted, the processor is configured to cause the correction device to correct the output signal in a direction to reduce the amount of operation.

5. The shovel according to claim 1, further comprising an adjustment valve capable of adjusting the flowrate of the hydraulic oil supplied to a bottom-side hydraulic chamber of the boom cylinder or discharged from the rod-side hydraulic chamber, wherein in the state in which the traveling body is lifted, the processor is configured to cause the adjustment valve to adjust the flowrate so as to reduce the flowrate.

6. The shovel according to claim 1, wherein in the state in which the traveling body is lifted, the processor is configured to relatively slow down the operation of the attachment, and in a case where a certain period of time elapses since a start of an operation for terminating the state in which the traveling body is lifted, the processor is configured to return a movement speed of the attachment back to an original state.

7. The shovel according to claim 1, wherein in the state in which the traveling body is lifted, the processor is configured to relatively slow down the operation of the attachment, and in a case where the shovel thereafter becomes no longer in the state in which the traveling body is lifted, the processor is configured to return a movement speed of the attachment back to an original state.

8. A shovel comprising:

a traveling body;

a turning body turnably mounted on the traveling body;

an attachment attached to the turning body and including a boom, an arm, and a bucket; and a processor, wherein the processor is configured to relatively slow down an operation of the attachment in such a direction as to terminate a state in which the traveling body is lifted, after the shovel enters the state in which the traveling body is lifted, and wherein in a case where the shovel enters the state in which the traveling body is lifted, the processor is configured to automatically terminate the state in which the traveling body is lifted while relatively slowing down a movement speed of the attachment.

9. A shovel comprising:

a traveling body;

a turning body turnably mounted on the traveling body;

an attachment attached to the turning body and including a boom, an arm, and a bucket; and a processor, wherein the processor is configured to relatively slow down an operation of the attachment in such a direction as to terminate a state in which the traveling body is lifted, after the shovel enters the state in which the traveling body is lifted, and wherein in the state in which the traveling body is lifted, the processor is configured to terminate the state in which the traveling body is lifted while relatively slowing down a movement speed of the attachment when an operation for terminating the state in which the traveling body is lifted is performed.

* * * * *